US007681971B2

(12) United States Patent
Berger et al.

(10) Patent No.: US 7,681,971 B2
(45) Date of Patent: Mar. 23, 2010

(54) INK JET APPARATUS

(75) Inventors: Sharon S. Berger, Canby, OR (US); Andrey S. Kim, Woodburn, OR (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 11/296,142

(22) Filed: Dec. 7, 2005

(65) Prior Publication Data

US 2006/0082608 A1 Apr. 20, 2006

Related U.S. Application Data

(60) Division of application No. 10/897,527, filed on Jul. 22, 2004, now abandoned, which is a continuation of application No. 10/283,888, filed on Oct. 30, 2002, now abandoned.

(51) Int. Cl.
*B41J 29/38* (2006.01)

(52) U.S. Cl. ..... 347/11

(58) Field of Classification Search ..... 347/11, 347/10

See application file for complete search history.

(56) References Cited

U.S. PATENT DOCUMENTS

| | | | | |
|---|---|---|---|---|
| 5,736,993 | A | 4/1998 | Regimbal et al. | |
| 6,186,610 | B1 * | 2/2001 | Kocher et al. | 347/11 |
| 6,217,141 | B1 | 4/2001 | Nakamura et al. | |
| 6,305,773 | B1 | 10/2001 | Burr et al. | |
| 6,312,080 | B1 | 11/2001 | De Roos et al. | |
| 6,354,686 | B1 | 3/2002 | Tanaka et al. | |
| 2001/0022596 | A1 | 9/2001 | Korol | |

FOREIGN PATENT DOCUMENTS

| | | | | |
|---|---|---|---|---|
| WO | WO 97/35167 | * | 6/1997 | 347/11 |

* cited by examiner

*Primary Examiner*—Julian D Huffman
(74) *Attorney, Agent, or Firm*—Marger Johnson & McCollom, P.C.

(57) ABSTRACT

A drop emitting device that includes a drop generator, a drive signal including a plurality of fire intervals applied to the drop generator, wherein the drive signal includes in each fire interval a bi-polar drop firing waveform or a time varying non-firing waveform.

3 Claims, 4 Drawing Sheets

INK JET APPARATUS

This is a divisional of U.S. Continuation application Ser. No. 10/897,527, filed Jul. 22, 2004 now abandoned, which is a continuation of U.S. application Ser. No. 10/283,888, filed Oct. 30, 2002, now abandoned.

BACKGROUND OF THE DISCLOSURE

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet drop generator structure employs an electromechanical transducer to displace ink from an ink chamber into a drop forming outlet passage, and it can be difficult to control drop velocity and/or drop mass.

DETAILED DESCRIPTION OF THE DISCLOSURE

Figure 1:
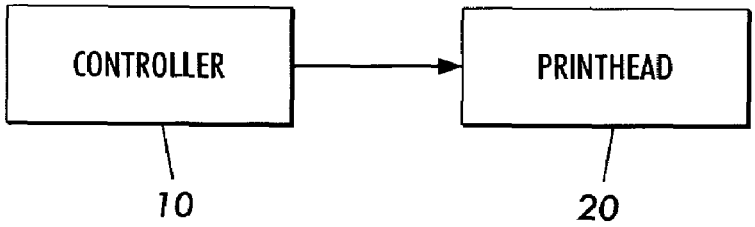
FIG. 1 is a schematic block diagram of an embodiment of a drop-on-demand drop emitting apparatus.

FIG. 1 is schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
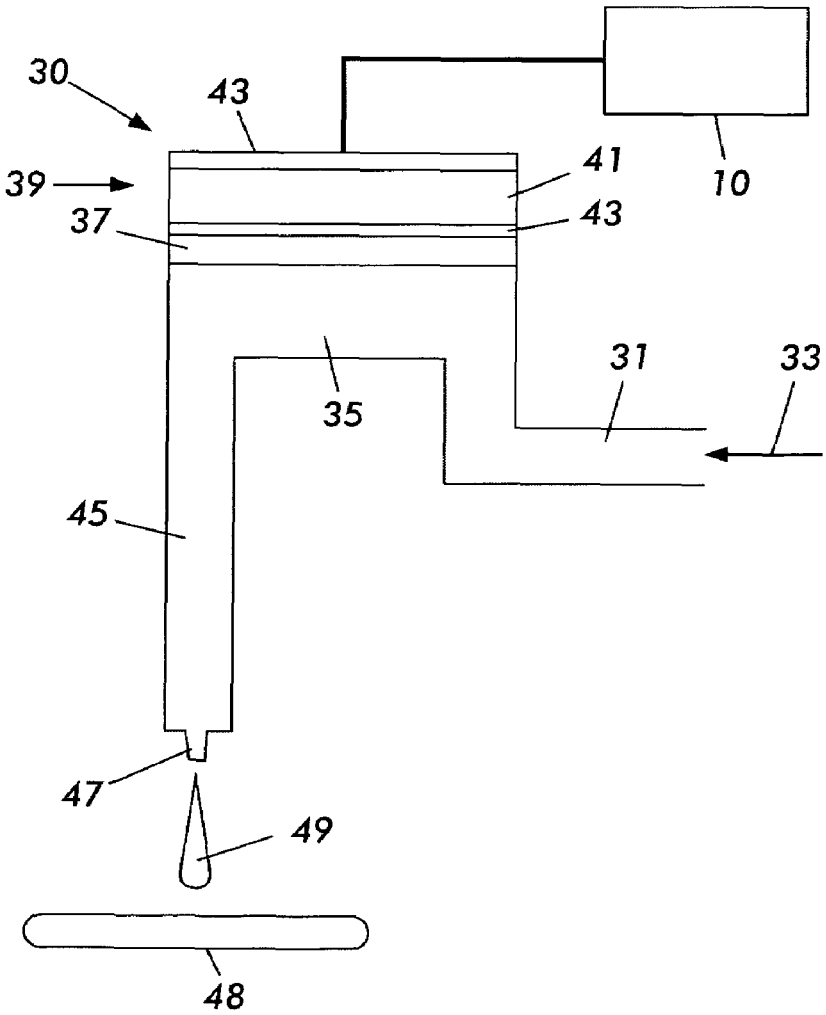
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. An electromechanical transducer 39 is attached to the flexible diaphragm 37 and can overlie the pressure chamber 35, for example. The electromechanical transducer 39 can be a piezoelectric transducer that includes a piezo element 41 disposed for example between electrodes 43 that receive drop firing and non-firing signals from the controller 10. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
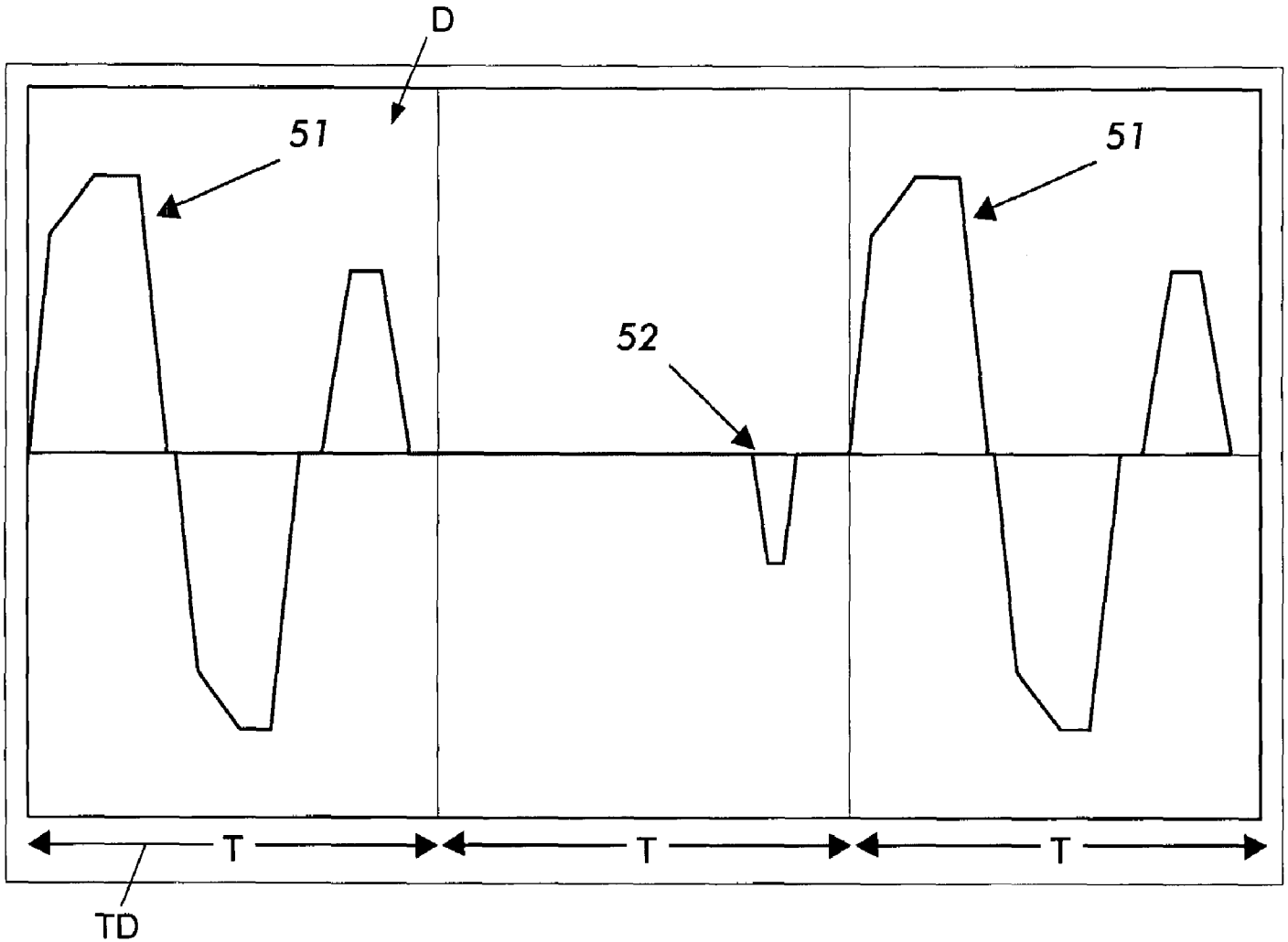
FIG. 3 is a schematic depiction of an embodiment of a drive signal that can be employed to drive the drop generator of FIG. 2.

FIG. 3 is a schematic diagram of an example of a drive signal D for energizing the drop generator of FIG. 2. The drive signal D includes a plurality of sequential fire intervals TD of time duration T, and within each fire interval TD the drive signal D includes either a time varying drop firing signal or waveform 51, or a time varying non-firing signal or waveform 52. The time varying drop firing waveform 51 is shaped or configured to actuate the electromechanical transducer such that the drop generator emits an ink drop, while the non-firing waveform 52 is shaped or configured to perturb the electromechanical transducer without causing a drop to the emitted. By way of illustrative example, the firing interval duration T can be in the range of about 56 microseconds to about 28 microseconds, such that the drop generator can be operated in the range of about 18 KHz to about 36 KHz. As another example, the firing interval duration T can be in the range of about 1000 microseconds to about 28 microseconds, such that the drop generator can be operated in a range of about 1 KHz to about 36 KHz.

The time varying non-firing waveform can be configured to set the condition of the drop generator 30 for the next fire interval.

For example, the time varying non-firing waveform 52 can be shaped or configured to place the drop generator 30 in a fluid dynamics condition similar to the fluid dynamics condition the drop generator 30 would be in after firing a drop. In this manner, the drop generator 30 is placed in substantially the same fluid dynamics condition each time the drop generator fires, which can provide for more consistent drop velocity and/or drop mass over a broad range of operating conditions.

As another example, the time varying non-firing waveform 52 can be shaped or configured such that the spectral energy of the drive signal is approximately the same for different firing patterns. In other words, the spectral energy of the drive signal is approximately the same regardless of whether a sequence of fire intervals includes only drop firing waveforms or includes drop firing waveforms and non-firing waveforms.

Alternatively, the time varying non-firing waveform can be shaped or configured so that it does affect the spectral energy of the drive signal, which can affect the condition of the drop generator. That is, the spectral energy of the drive can vary with firing pattern.

In a further example, the time varying non-firing waveform 52 can be shaped or configured to reduce variation in drop velocity such that drop velocity is approximately constant regardless of whether a given drop firing waveform follows a drop firing waveform or a non-firing waveform. In other words, the drop velocity is not substantially affected by the firing pattern.

Also, the time varying non-firing waveform 52 can be shaped or configured to reduce variation in drop mass such that drop mass is approximately constant regardless of whether a given drop firing waveform follows a drop firing waveform or a non-firing waveform. In other words, drop mass is not substantially affected by the firing pattern.

The time varying non-firing waveform 52 can further be shaped or configured to change a drop parameter when a given drop firing waveform follows a non-firing waveform.

By way of illustrative example, as depicted in FIG. 3, the time varying drop firing waveform 41 can be a bi-polar voltage signal having a component that is greater than 0 volts and a component that is less than 0 volts. Alternatively, the time varying drop firing waveform can be a signal that includes a pulse component that is greater than a reference and a pulse component that is less than the reference.

The time varying non-firing waveform can be a unipolar voltage signal such as a pulse that can be positive or negative, for example relative to a reference. A non-firing pulse can have a pulse duration that is less than a fire interval, for example, wherein pulse duration can be measured for convenience between pulse transition times (i.e., the transition from the reference and the transition to the reference. A non-firing pulse can be located anywhere in a fire interval. For example, a non-firing pulse can be approximately centered in a fire interval or it can be located only in either the first half or the second half of a fire interval. By way of specific example, the time varying non-firing waveform can be a negative going pulse having a width that is in the range of about 10% to about 90% of the firing interval T (i.e., about 0.1 T to about 0.9 T).

Figure 4:
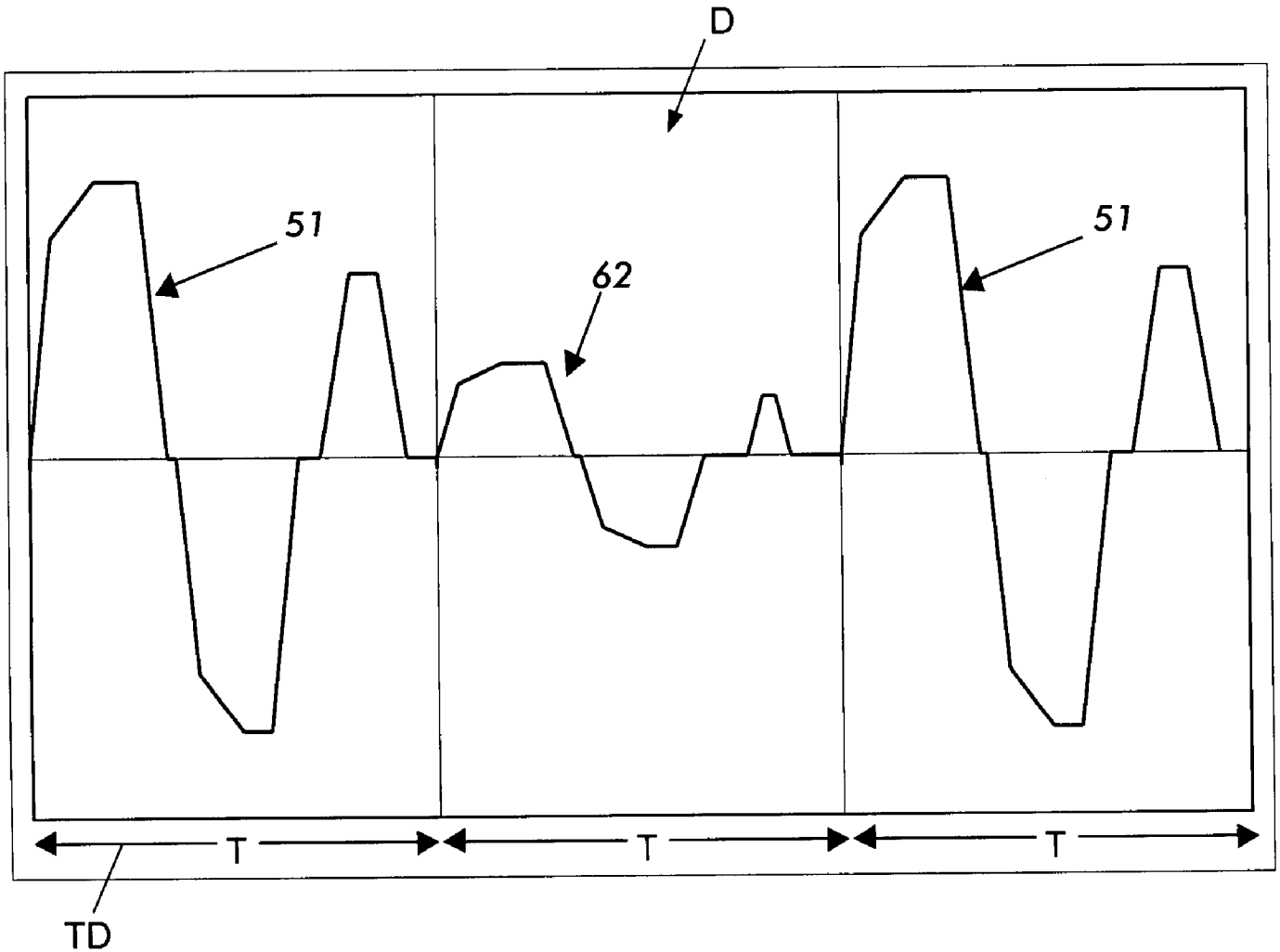
FIG. 4 is a schematic depiction of another embodiment of a drive signal that can be employed to drive the drop generator of FIG. 2.

As another example, illustrated in FIG. 4, a time varying non-firing waveform 62 can be a reduced voltage or amplitude version of the firing waveform 51.

Figure 5:
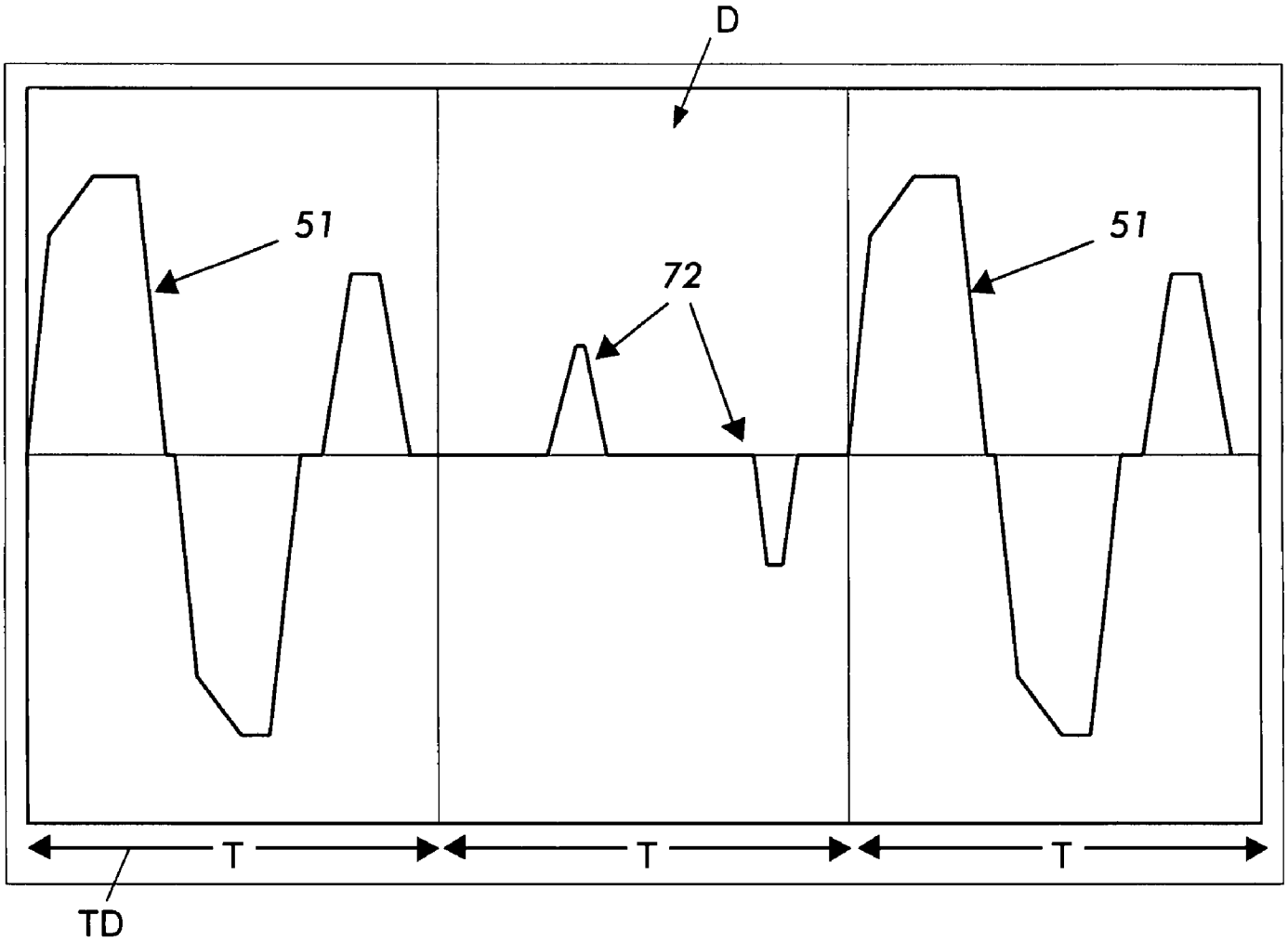
FIG. 5 is a schematic depiction of a further embodiment of a drive signal that can be employed to drive the drop generator of FIG. 2.

As a further example illustrated in FIG. 5, a time varying non-firing waveform 72 can comprise two pulses, one positive pulse in the first half of a firing interval and a negative pulse in the second half of the firing interval. The width of each pulse can be in the range of about 10% to about 50% of the firing interval duration T.

The invention has been described with reference to disclosed embodiments, and it will be appreciated that variations and modifications can be affected within the spirit and scope of the invention.

What is claimed is:

1. A drop emitting device comprising:

a drop generator having an electromechanical transducer; and a controller to supply a drive signal to the electromechanical transducer including:

a first fire interval, and a second fire interval applied to the drop generator, the first and second fire intervals being separate, contiguously adjacent, non-overlapping and in sequence starting with the first fire interval, and each of the first and second fire intervals having a duration T;

the first fire interval having a drop firing bi-polar waveform of first and second pulses of first and second polarities and a third pulse having a first polarity, and the second fire interval including one non-firing unipolar pulse that is the only non-firing pulse in the second fire interval; and wherein the second fire interval, which includes one and only one non-firing unipolar pulse, does not cause a drop to be fired.

2. The drop emitting device of claim 1 wherein the non-firing unipolar pulse is a negative going pulse that is located only in a second half of the second fire interval.

3. The drop emitting device of claim 1, wherein the one non-firing unipolar pulse places the drop emitting device in a fluid dynamic condition the same as a fluid dynamic condition caused by the third pulse having the first polarity in the drop firing waveform.

* * * * *